US010517351B2

(12) United States Patent
Arciuolo

(10) Patent No.: US 10,517,351 B2
(45) **Date of Patent: *Dec. 31, 2019**

(54) SHOE WITH INTEGRAL ORTHOTIC/PROPULSION PLATE

(71) Applicant: Roar Athletic Performance Corp., Milford, CT (US)

(72) Inventor: Matthew J. Arciuolo, Milford, CT (US)

(73) Assignee: Roar Athletic Performance Corp., Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/316,636

(22) PCT Filed: Jun. 5, 2015

(86) PCT No.: PCT/US2015/034429

§ 371 (c)(1),
(2) Date: Dec. 6, 2016

(87) PCT Pub. No.: WO2015/188075

PCT Pub. Date: Dec. 10, 2015

(65) Prior Publication Data

US 2017/0196306 A1 Jul. 13, 2017

Related U.S. Application Data

(60) Provisional application No. 62/008,577, filed on Jun. 6, 2014.

(51) Int. Cl.
*A43B 13/18* (2006.01)
*A43B 7/14* (2006.01)
(Continued)

(52) U.S. Cl.
CPC ..... *A43B 13/183* (2013.01); *A43B 5/00* (2013.01); *A43B 5/02* (2013.01); *A43B 5/06* (2013.01);
(Continued)

(58) Field of Classification Search
CPC .. A43B 5/02; A43B 5/06; A43B 7/141; A43B 7/142; A43B 13/026; A43B 13/1421; A43B 13/183
(Continued)

(56) References Cited

U.S. PATENT DOCUMENTS 898,084 A 9/1908 Backermann
3,161,970 A 12/1964 Purtell
(Continued)

FOREIGN PATENT DOCUMENTS

DE 4414064 11/1994
WO WO 2007/046133 A1 1/2003

OTHER PUBLICATIONS

Clark et al., Reinforced Lower-Limb Orthosis-Design Principles, Orthotics and Prosthetics, vol. 32, No. 2, pp. 35-45, Jun. 1978.
(Continued)

*Primary Examiner* — Anne M Kozak
(74) *Attorney, Agent, or Firm* — McCarter & English, LLP

(57) ABSTRACT

A shoe with an integral orthotic or propulsion plate is provided that includes a shoe defining an upper and a sole, and an orthotic or propulsion plate positioned between the upper of the shoe and the sole of the shoe. The orthotic or propulsion plate defines a toe platform region, a longitudinal arch pad region, and a heel region. In the absence of an applied force to the top surface of the orthotic or propulsion plate and with the sole of the shoe resting on a horizontal surface, the orthotic or propulsion plate bows upward in the
(Continued)

longitudinal arch pad region relative to the toe platform region and the heel region. In response to a force being applied to the top surface of the orthotic or propulsion plate, the bowed longitudinal arch pad region flexes downward relative to the toe pad region and the heel region to load a first preload force in the orthotic or propulsion plate. In response to the heel region thereafter moving upward, the bowed longitudinal arch pad flexes upward and the first pre-load force is released to deliver a propulsive force to the top surface of the orthotic or propulsion plate; and the orthotic or propulsion plate flexes to define a flex angle β between the toe platform region and the longitudinal arch pad region and to load a second pre-load force into the orthotic or propulsion plate. In response to the toe platform region thereafter moving upward, the orthotic or propulsion plate returns from its flexed position to eliminate the flex angle β; and the second pre-load force is released to deliver a propulsive force to the top surface of the orthotic or propulsion plate.

4 Claims, 8 Drawing Sheets

(51) Int. Cl.

| | |
|---|---|
| ***A43B 13/02*** | (2006.01) |
| ***A43B 5/02*** | (2006.01) |
| ***A43B 5/06*** | (2006.01) |
| ***A43B 13/14*** | (2006.01) |
| ***A43B 5/00*** | (2006.01) |

(52) U.S. Cl.
CPC ..... *A43B 7/14* (2013.01); *A43B 7/141* (2013.01); *A43B 7/142* (2013.01); *A43B 7/143* (2013.01); *A43B 7/144* (2013.01); *A43B 13/026* (2013.01); *A43B 13/141* (2013.01)

(58) Field of Classification Search
USPC ..... 36/91
See application file for complete search history.

(56) References Cited

U.S. PATENT DOCUMENTS

| | | | | |
|---|---|---|---|---|
| 4,155,180 | A | 5/1979 | Phillips | |
| 4,858,338 | A | 8/1989 | Schmid | |
| 4,899,465 | A | 2/1990 | Bleimhofer et al. | |
| 5,052,130 | A | 10/1991 | Barry et al. | |
| 5,123,180 | A | 6/1992 | Nannig et al. | |
| 5,179,791 | A | 1/1993 | Lain | |
| 5,191,727 | A | 3/1993 | Barry | |
| 5,367,790 | A | 11/1994 | Gamow et al. | |
| 5,528,842 | A | 6/1996 | Ricci | |
| 5,642,575 | A * | 7/1997 | Norton | A43B 13/181 36/27 |
| 5,647,147 | A | 7/1997 | Coomer | |
| 5,689,903 | A | 11/1997 | Aumann | |
| D391,749 | S * | 3/1998 | Fisher | D2/961 |
| 5,778,562 | A | 7/1998 | Karl-Heinz | |
| 6,029,374 | A | 2/2000 | Herr | |
| 6,247,249 | B1 | 6/2001 | Lindqvist | |
| 6,449,878 | B1 | 9/2002 | Lyden | |
| 6,470,599 | B1 | 10/2002 | Chu | |
| 6,502,330 | B1 | 1/2003 | David et al. | |
| 6,560,902 | B1 | 5/2003 | Eschweiler | |
| D475,184 | S * | 6/2003 | Polifroni | D2/961 |
| 6,681,501 | B1 * | 1/2004 | Polifroni | A43B 1/0009 36/147 |
| 6,745,501 | B2 | 6/2004 | Brown | |
| 6,915,598 | B2 | 7/2005 | Grisoni | |
| 7,062,865 | B1 | 6/2006 | Nordt, III | |
| 7,266,910 | B2 | 9/2007 | Ingimundarson | |
| 7,401,422 | B1 | 7/2008 | Scholz et al. | |
| 7,487,604 | B2 | 2/2009 | Perron, Jr. | |
| 7,513,880 | B2 | 4/2009 | Ingimmundarson et al. | |
| 7,900,376 | B2 | 3/2011 | Rabushka | |
| 8,028,442 | B2 | 10/2011 | Hodgson | |
| 8,191,285 | B2 | 6/2012 | Perron, Jr. | |
| 8,631,592 | B2 | 1/2014 | Adair et al. | |
| 8,695,235 | B2 | 4/2014 | Perron, Jr. | |
| 9,131,746 | B2 | 9/2015 | Arciuolo | |
| 2002/0166184 | A1 | 11/2002 | Lindqvist | |
| 2003/0061735 | A1 | 4/2003 | Polifroni | |
| 2003/0061739 | A1 * | 4/2003 | Polifroni | A43B 7/141 36/91 |
| 2004/0102727 | A1 | 5/2004 | Smits | |
| 2004/0154192 | A1 | 8/2004 | Bengtsson et al. | |
| 2005/0081401 | A1 | 4/2005 | Singleton et al. | |
| 2008/0022554 | A1 | 1/2008 | Meschter | |
| 2009/0217551 | A1 | 9/2009 | Shirokikh | |
| 2009/0307925 | A1 | 12/2009 | Pfister | |
| 2010/0083534 | A1 | 4/2010 | Howlett | |
| 2010/0218399 | A1 | 9/2010 | Jeong | |
| 2012/0198723 | A1 | 8/2012 | Borisov | |
| 2014/0000125 | A1 | 1/2014 | Butler | |
| 2014/0059895 | A1 | 3/2014 | Arciuolo | |

OTHER PUBLICATIONS

Zukas, et al., The Influence of Nanofillers on the Mechanical Properties of Carbon Fibre Reinforced Methyl Methacrylate Composite, Materials Science (Medziagotyra), vol. 18, No. 3, pp. 250-255, 2012.

PCT International Search Report and Written Opinion dated Sep. 2, 2015 for PCT/US2015/034429.

Lipfert, et al., Impulsive Ankle Push-Off Powers Leg Swing in Human Walking, The Journal of Experimental Biology, 21 pages, 2014.

U.S. Appl. No. 13/596,559, filed Aug. 28, 2012, U.S. Pat. No. 9,131,746.

PCT/US2015/034429, Jun. 5, 2015, WO 2015/188075.

U.S. Appl. No. 62/008,577, filed Jun. 6, 2014.

* cited by examiner

SHOE WITH INTEGRAL ORTHOTIC/PROPULSION PLATE

CROSS-REFERENCES

This patent application claims priority benefit to a provisional patent application entitled "Shoe with Integral Orthotic," which was filed on Jun. 6, 2014, and assigned Ser. No. 62/008,577. This application is also related to a co-pending patent application entitled "Foot Orthotic, which was filed on Aug. 28, 2012, and assigned Ser. No. 13/596,559. The entire content of the foregoing patent applications is fully incorporated by reference herein.

TECHNICAL FIELD

The present invention generally relates to foot orthotics designed to increase propulsion and, more specifically, to a foot orthotic/propulsion plate that is integral to a shoe.

BACKGROUND

Foot orthoses normally include a specially fitted insert or footbed to a shoe. Also commonly referred to as "orthotics", these inserts may provide support for the foot by distributing pressure or realigning foot joints while standing, walking or running. As such, they are often used by athletes to relieve symptoms of a variety of soft tissue inflammatory conditions like plantar fasciitis. Also, orthotics have been designed to address arch support or cushioning requirements.

Orthotics currently on the market are generally designed for support (stabilization of the arch or foot) or cushioning (gel, foam, springs, air bladders, etc.) or a combination thereof. Other developments in the footwear marketplace have been primarily focused on increasing the cushioning, flexibility and comfort of the shoe. Virtually every improvement in the last 50 years in the footwear industry has been to improve one of these three characteristics, i.e., cushioning, flexibility and/or comfort. Therefore, the need to improve propulsion (performance) is not being met commensurate with the ability of today's materials. Up until the last several years, there was no material available that could provide the advantageous spring while at the same time being lightweight and streamlined enough to fit into a shoe.

Thus, there is a need and an opportunity for an invention that improves the performance of an individual based on the properties of his/her shoe. These and other objectives are satisfied by the shoes of the present disclosure.

SUMMARY

The disclosed shoe has a pre-impregnated carbon fiber performance plate that is placed between the upper and the sole. Due to the properties of pre-preg carbon fibers, the layers of carbon fiber are arranged so that the plate is the stiffest where the pressure is greatest and gradually gets more flexible as it runs distally toward the toes. The layers of carbon fiber are also placed on a bias to maximize spring compression for the most energy storage. The purpose of this plate is to pre-load a spring at heel off, during the human gait cycle, resulting in the unloading of the spring upon toe-off. Since the loaded spring cannot move the ground beneath the user, it moves the user. This loaded spring releases its energy as the user's foot pushes off the ground on the way to the next step. The carbon fiber plate is upwardly arched from heel to toe and torqued so that the medial toe is inferior to the lateral toe. This orientation follows the center of mass during the gait cycle, assisting the flow of gait.

With the availability of new, lighter weight, more durable materials, such as pre-impregnated ("pre-preg") carbon fibers, a shoe has been designed according to the present disclosure to improve the athletic performance of the user. With the use of pre-preg carbon fibers, stiffness and flexibility can be precisely placed so that maximum and/or optimal spring force can be achieved.

According to exemplary embodiments of the present disclosure, a pair of shoes are provided, each shoe including a built-in composite propulsion plate as disclosed herein. The composite propulsion plate may advantageously feature or encompass an elliptical leaf spring design that improves the propulsion capability of the human foot. Like an elliptical leaf spring, the disclosed composite propulsion plate may feature graded thicknesses running along the length of the plate. This composite element is built-in to the shoe, generally between the upper and the sole of the shoe.

This shoe/propulsion plate combination increases the down force exerted against the ground during walking, running or jumping, upon the ground, thereby propelling the user forward or upward, whichever is desired. This increase in propulsion is invaluable for sprinting, running, basketball, hurdling, high jumping, long jumping, volleyball, etc., i.e., wherever maximum "push" or "loft" is desired. This additional energy return is designed to improve performance in virtually any sport or activity.

Today's athlete, whether in grade school, high school, college or pro sports is always looking for that "edge", that little bit of added power to increase speed or distance in various sports, such as running, basketball, soccer, track, football, etc. A hundredth of a second speed increase or a small distance increase per step can make the difference between an average athlete and a winning athlete. That is the need that the disclosed shoe/propulsion plate combination fills.

Simply stated, the shoe/propulsion plate combination of the present disclosure meets the needs of end users interested in improving the efficiency of motion in relation to athletic activity. Utilizing a new way of looking at the role of footwear in regard to athletic performance, the disclosed combination, instead of making footwear more flexible, uses the inherent stiffness and spring rate of carbon fiber to store energy and increase down force against the ground, thereby propelling the user forward or upward in a more efficient manner, thereby reducing fatigue and increasing energy output.

Additional features, functions and benefits associated with the disclosed combination will be apparent from the description which follows, particularly when read in conjunction with the appended figures.

BRIEF DESCRIPTION OF THE DRAWINGS

The present disclosure will be better understood by those skilled in the pertinent art by referencing the accompanying drawings, where like elements are numbered alike in the several figures, in which.

DESCRIPTION OF EXEMPLARY EMBODIMENT(S)

Figure 1:
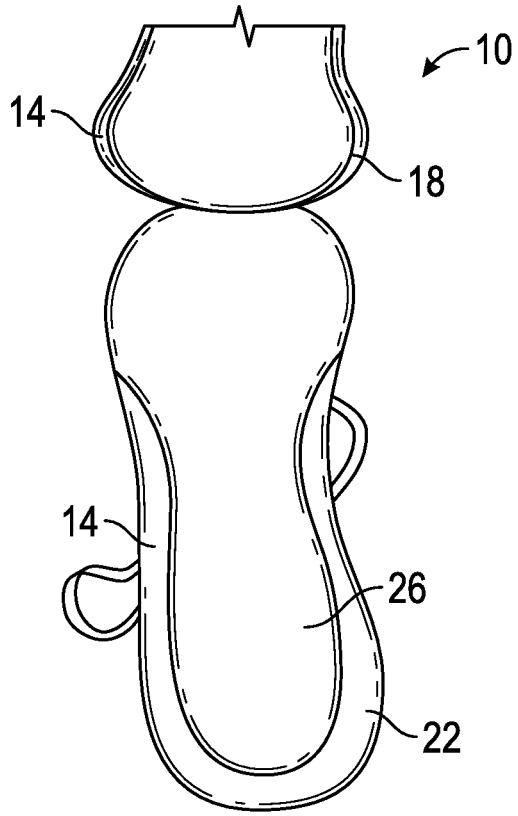
FIG. 1 is a rear view of an athletic shoe.

Generally, the disclosed shoe has a pre-impregnated carbon fiber performance plate that is placed between the upper and the sole. The plate may include an elliptical leaf spring design with the capability of extreme flex. Due to the properties of pre-preg carbon fibers, the layers of carbon fiber are arranged so that the plate is the stiffest where the pressure is greatest and gradually gets more flexible as it runs distally toward the toes. The layers of carbon fiber are also placed on a bias to maximize spring compression for the most energy storage. The purpose of this plate is to pre-load a spring at heel off, during the human gait cycle, resulting in the unloading of the spring upon toe-off. Since the loaded spring cannot move the ground beneath the user, it moves the user. This loaded spring releases its energy as the user's foot pushes off the ground on the way to the next step. The carbon fiber plate is upwardly arched from heel to toe and torqued so that the medial toe is inferior to the lateral toe. This orientation follows the center of mass during the gait cycle, assisting the flow of gait.

The plate increases the plantar flexion moment (rate and amount of down force) at the inferior (bottom) of the metatarsal as it heads distally toward the toes, propelling the user forward or upward or any combination thereof, depending upon the activity. For example, a high jumper would require mainly loft upward, a long jumper would require loft upward and distance forward, and a sprinter would require forward force only. All three of these requirements may be advantageously fulfilled according to the present disclosure.

Pre-impregnated carbon fiber have only been in use in the orthopedic/orthotic field in recent years. The only known products that utilize pre-preg carbon fiber in the footwear/orthopedic field are AFO orthotics (Ankle/Foot Orthotics) and prosthetic applications. For example, use of pre-preg fibers in prosthetic applications is designed to provide spring for amputee patients in order to gait more normally. The purpose of using carbon fiber in the prosthetic field is to provide the wearer with a lightweight, efficient spring that the human foot and leg would normally produce. The application of pre-preg fibers to the performance world is believed to be unique to the present disclosure (and applicant's related application incorporated herein by reference).

The carbon fiber layers are placed in such a way in the spring plate, so that there are more layers under the metatarsal heads (ball of the foot), where there is the most down force exerted by the foot, gradually getting thinner (less layers) progressively as one approaches the toes, where there is less down force. This ability to gradually lower the stiffness of the plate as we head distally, gives maximum spring to the user, something that cannot be done with standard, non-layered materials. The carbon layers can also be arranged on various biases in order to increase or decrease stiffness as desired for any particular activity. To maximize the spring effect, the plate/sole are shaped in a slight arc from heel to toe so that just by the user stepping on it, a slight pre-load is achieved. The sole/plate combination is also slightly torqued, so that the medial distal aspect (under the great toe) is lower (inferior) than the lateral aspect (little toe). This maximizes the spring effect by using the natural flow of the gait cycle, (laterally from the heel) to medially at the great toe.

There are 4 phases of gait: Heel strike: When the foot initially contacts the ground while walking or running. At heel strike the posterior (rear) of the plate deflects slightly, attenuating shock and allowing a smooth flow to the next phase. Foot Flat: When both the heel and the forefoot are on the ground at the same time. At this point the tibia and the body's center of mass (COM) is passing over the foot. At foot flat, the sole/plate's slight arch from heel to toe provides a pre-load to increase the spring force going into the next phase. Heel off: When the foot is flexed with the heel off of the ground. At heel off, when the foot is maximally flexed, is when the potential energy of the plate is stored ready to be released. Toe off: When the foot leaves the ground on its way to the next step. At toe-off is when the potential energy stored in foot flat and heel off is released explosively, increasing the force and rate of plantar flexion extension, propelling the user forward or upward or a combination thereof. The shoe/plate combination assists the body's natural spring generated during gait. As stated before, the foot/shoe combination obviously cannot move the ground underneath the user, so the energy has no choice but to move the user.

The performance plate is made from arranging layers of pre impregnated composite material in such a way to accomplish stiffness where the most force from the human foot is and flexion, where the weaker part of the foot is and installing it in the sole or midsole of the shoe. The superior aspect of the sole is routed out to accept the plate so that the plate is flush with the top of the sole. Next, the upper is applied to the sole/plate combination. This way the upper, performance plate and sole work together seamlessly to create the optimal arched shape and flex, critical to performance.

Following is an exemplary manufacturing process for pre-preg composite and its molding into final form: Pre-preg composite material is arranged (layered) in such a way as to increase spring effect. This fabric is heated and pressed into the desired shape and allowed to cure. The number of layers and the layout of the fabric used are entirely dependent upon the application. The fabric layers can be arranged on biases that are proprietary for maximum spring effect. For example, for a leaping sport, more layers of fabric can be applied at a different bias, because propelling a human straight up requires more energy than propelling a human running forward.

Figure 2:
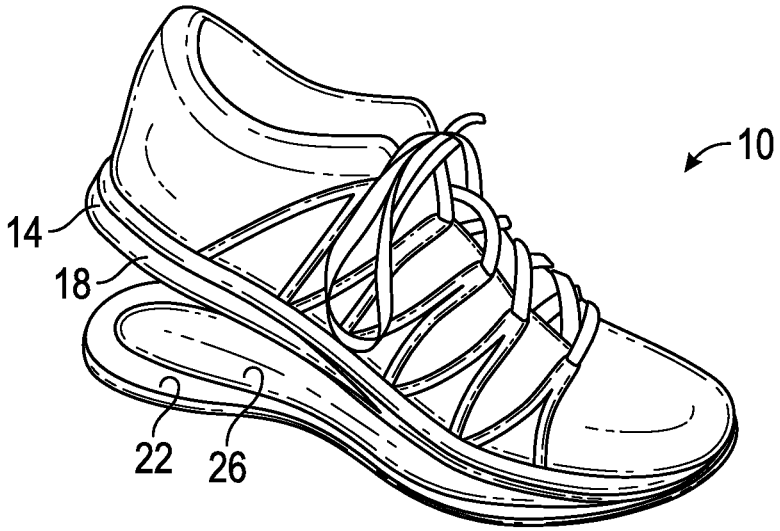
FIG. 2 shows a side view of the shoe from FIG. 1.

FIG. 1 shoes a rear view of an athletic shoe 10 with the sole 14 cut into two pieces an upper sole 18 and a lower sole 22. The orthotic plate that is integral with the shoe will be located between the upper sole 18 and lower sole 22, generally in the dark area 26. The plate is not shown in this view. FIG. 2 shows a side view of the shoe 10 from FIG. 1.

Figure 3:
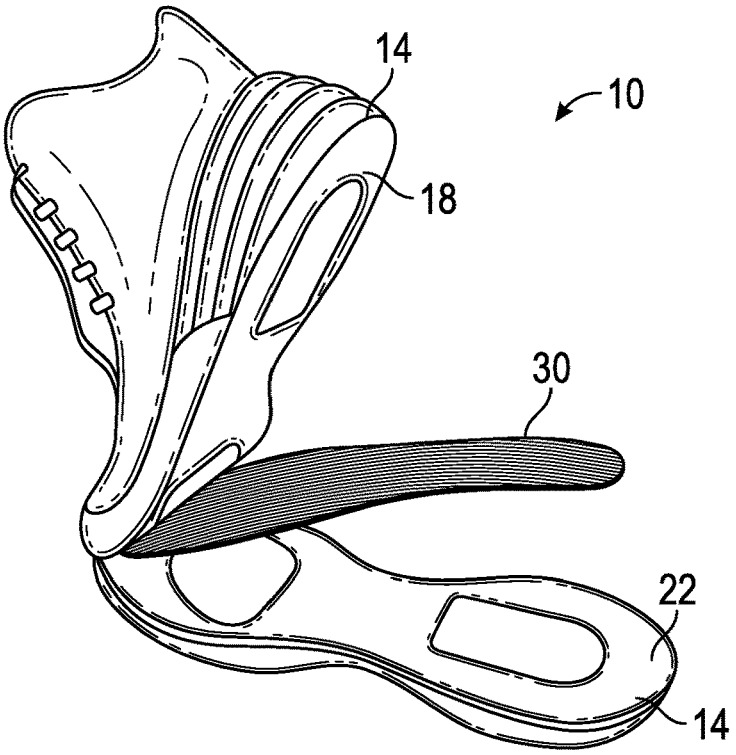
FIG. 3 shows a rear perspective view from the left side of an athletic shoe.
Figure 4:
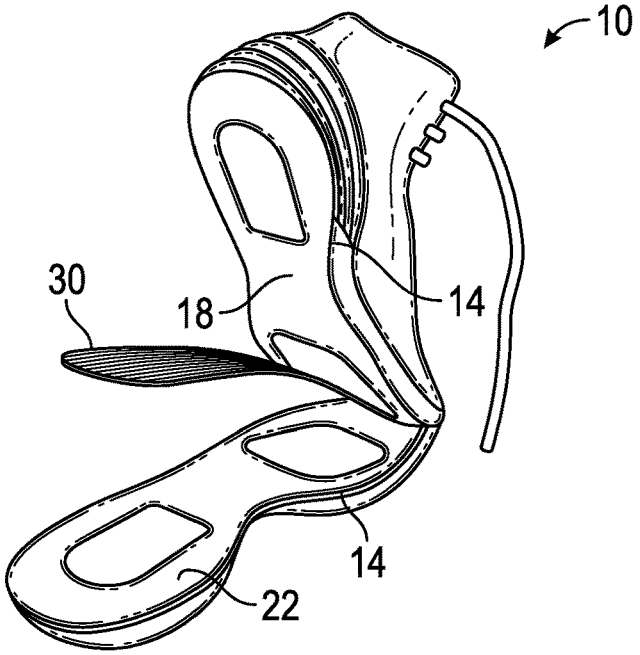
FIG. 4 is a rear perspective view from the right side of the shoe from FIG. 3.
Figure 5:
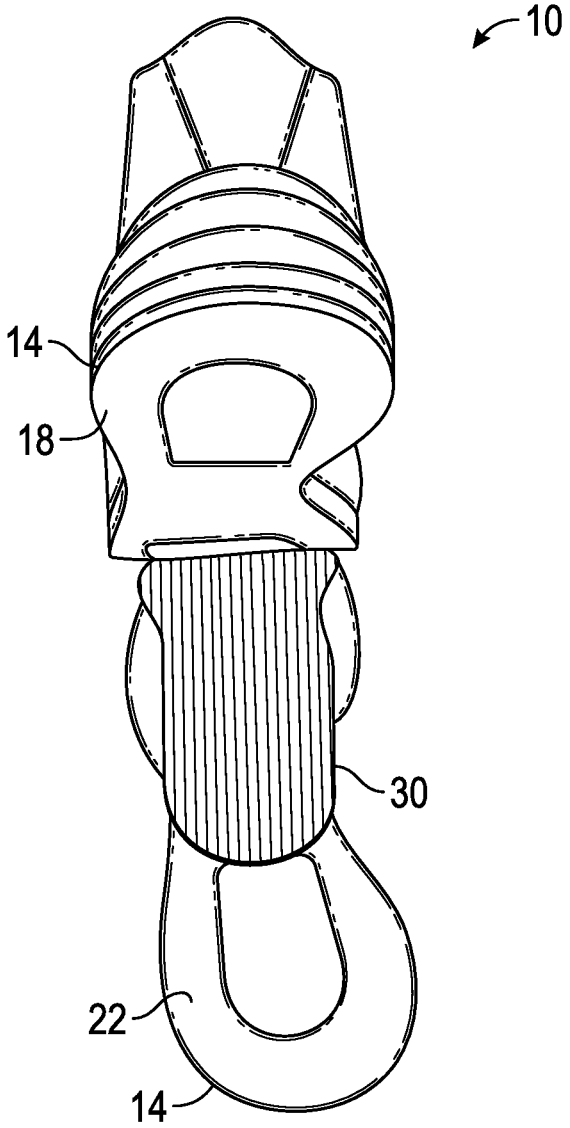
FIG. 5 shows a rear view of the shoe from FIG. 3.

FIG. 3 shows a rear perspective view from the left side of an athletic shoe 10, with an orthotic pre-preg carbon fiber composite plate 30 located between the upper sole 18 and lower sole 22. When the shoe 10 is ready for use, the upper sole 18 and lower sole 22 will form one single sole 14 with the orthotic plate 30 embedded within the sole 14. FIG. 4 is a rear perspective view from the right side of the shoe from FIG. 3. FIG. 5 shows a rear view of the shoe from FIG. 3.

As previously noted, the disclosed orthotic/propulsion plate is designed to increase propulsivity in walking, running and jumping activities. The orthotic/propulsion plate is designed with about a 15° plantar flexion from the ball of the foot to the toe and about a 5° plantar flexion from the 5th metatarsal to the hallux so that, as the user progresses through the phases of gait, the orthotic/propulsion plate progressively loads potential energy at foot flat and heel-off and releases that energy at toe off. This is accomplished by a number of design features.

The disclosed orthotic/propulsion plate is generally fabricated using pre-preg carbon fibers. Pre-preg is a term for "pre-impregnated" composite fibers where a material, such as epoxy is already present. These pre-preg carbon fibers may take the form of a weave or may be uni-directional. They already contain an amount of the matrix material used to bond them together and to other components during manufacture. The pre-preg are mostly stored in cooled areas since activation is most commonly done by heat. Hence, composite structures built of pre-pregs will mostly require an oven or autoclave to cure. Owing to the use of "pre-preg" carbon fiber in the disclosed orthotic/propulsion plate, the orthotic/propulsion plate can be designed with varying amounts of resistance or spring at specific parts thereof. Depending on how the pre-preg carbon fiber layers are arranged, the orthotic/propulsion plate can be stiff where the user needs it to be and flexible where it has to be.

This pre-preg layering is a process that is superior in that it can be tailored to accomplish an increase in propulsion by increasing the natural spring effect of the human arch and foot structure in an orthotic/propulsion plate. The carbon fiber layers may be thickest under the ball of the foot and to the heel where the weight is the greatest and gradually get thinner distally under the user's toes. This unique layering process tailors the spring effect of the orthotic/propulsion plate so that it is stiff where it is needed and flexible where it is necessary to maximize its effect on the human foot. Of note, orthotics are customarily shaped to mirror the shape and motion of the foot. The disclosed orthotic/propulsion plate may be shaped in the opposite direction using the body's own weight to load the spring, and the user's own motion to increase this spring potential in the orthotic/propulsion plate and then, owing to the stiffness and lightweight of carbon fiber, the spring is unloaded at a rapid rate, propelling the user forward.

The disclosed orthotic/propulsion plate can provide more "spring" or "push" to a sprinter that wants quicker, more explosive starts, a marathoner that is looking for more efficiency and stamina over longer distances, or a basketball player that wants higher standing jumps. In the sporting arena, a $100^{th}$ of a second can mean the difference between first and fourth place (i.e. track and field), and thus an athlete using the disclosed orthotic may have that advantage.

The disclosed orthotic/propulsion plate design loads the foot plate while just standing and this spring effect is amplified when the toes are dorsiflexed (turned up). As the foot leaves the ground, preparing for its next heel strike, the orthotic/propulsion plate unloads into plantarflexion at a rapid rate using ground reactive force to propel the user forward by amplifying push-off.

Prior art orthotics are curved and shaped to take the shape of the human foot conforming to every curve, not designed, as the disclosed orthotic/propulsion plate is, to maximize the providing of thrust either forward, upward, and/or laterally.

The pre-preg carbon fibers used to fabricate the disclosed orthotic/propulsion plate may be shipped as a dry loosely woven cloth. A variety of methods may be used to apply wet epoxy resin to the cloth and then let it set at room temperature to cure. Carbon fiber fabric that is pre-impregnated with epoxy resin from the manufacturer may be employed; such material may be a thick material that is applied in layers to the mold. Once it is applied, a clear plastic sheet may be mounted over the pre-preg and affixed to the edges of the mold with foam tape. This process creates an air tight seal between the inside of the mold and the outside. A vacuum pump is then applied and the air is removed. As the air is removed, the plastic presses against the pre-preg and against the inside of the mold. Next, the pre-preg is allowed to cure. Heat is then applied to the fiber/mold and the fiber is separated from the mold.

Figure 6:
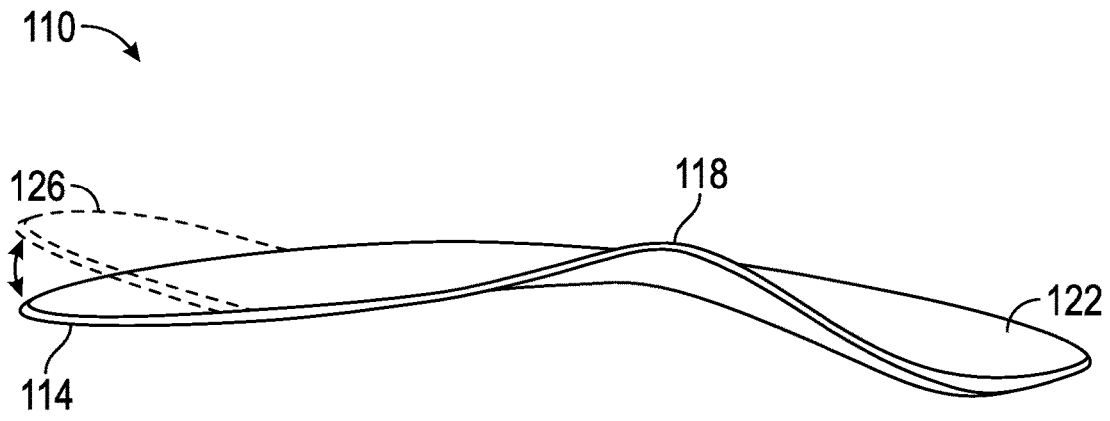
FIG. 6 is a side view of one embodiment of an orthotic/propulsion plate for use in the athletic shoe of the present disclosure.

FIG. 6 is a side view of one embodiment of the disclosed orthotic/propulsion plate 110. This figure shows a right foot orthotic. One of ordinary skill will recognize that the disclosed invention also includes left foot orthotics/propulsion plates. The orthotic/propulsion plate 110 may have a toe platform 114, a longitudinal arch pad 118 and a heel cup 122. One embodiment of how the orthotic/propulsion plate 110 can preload the spring function of the orthotic/propulsion plate is shown in dashed line 126. The dashed line 126 shows how the toe platform 114 can flex with respect to the rest of the orthotic/propulsion plate, providing a preload in the orthotic 110. When this preload is released, the orthotic/propulsion plate may provide thrust or propulsion to the user, which may help the user run faster, jump farther, jump higher, and/or push harder.

Figure 7:
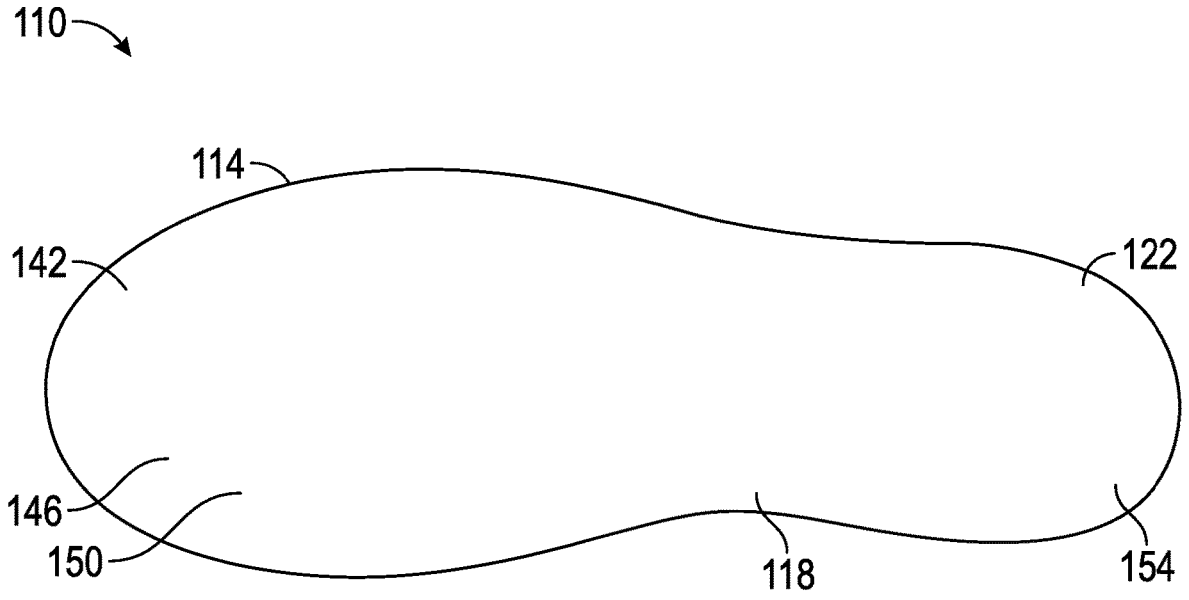
FIG. 7 is a top view of the orthotic/propulsion plate from FIG. 1.

FIG. 7 is a top view of the orthotic 110 from FIG. 6. FIG. 7 shows where thickness measurements were made below. Thicknesses were measured generally at the toe 142, sulcus 146, ball 150, and heel 154.

Figure 8:
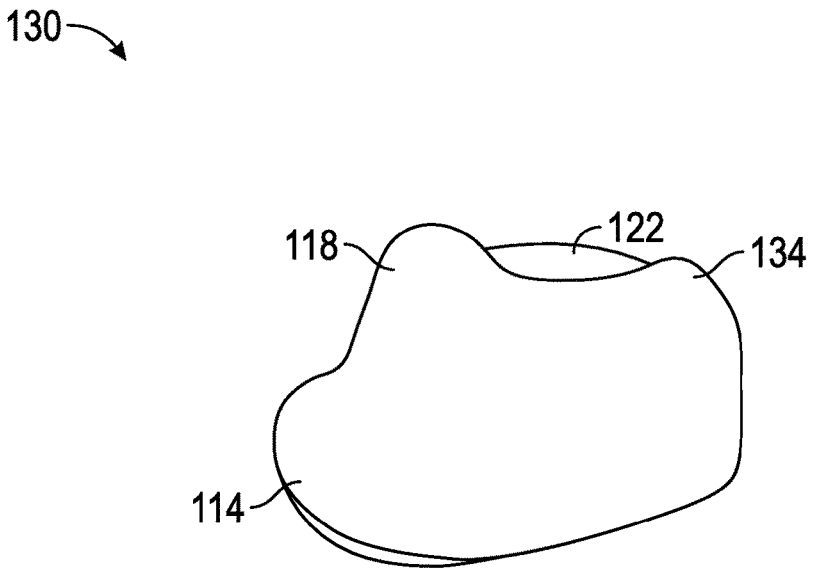
FIG. 8 is a front perspective view of another embodiment of a disclosed orthotic/propulsion plate.

FIG. 8 is a generally front perspective view of another embodiment of the disclosed orthotic/propulsion plate 130. The depicted orthotic/propulsion plate 130 is for a left foot. This embodiment of the orthotic/propulsion plate 130 may have a toe platform 114, a longitudinal arch pad 118, a heel cup 122, and a peroneal arch pad 134.

Figure 9:
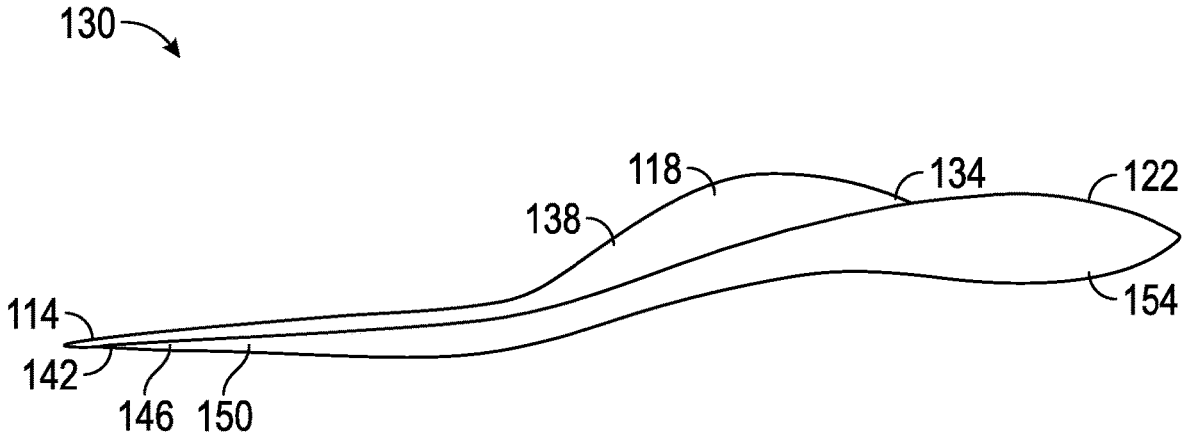
FIG. 9 is a side view of the orthotic/propulsion plate from FIG. 8.
Figure 10A:
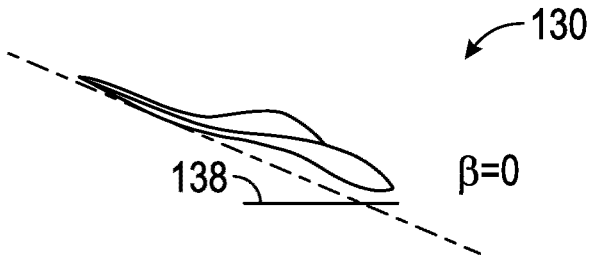
FIG. 10-A to FIG. 10-D are views of a right orthotic/propulsion plate during the different phases of a step or stride.
Figure 10B:
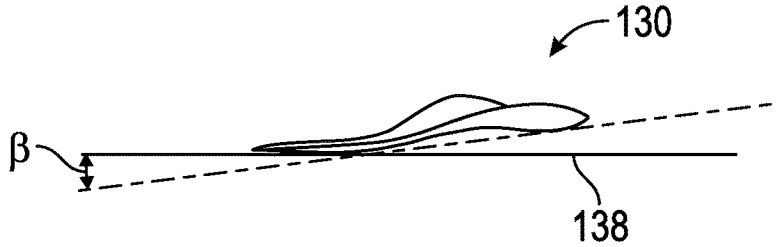
Figure 10C:
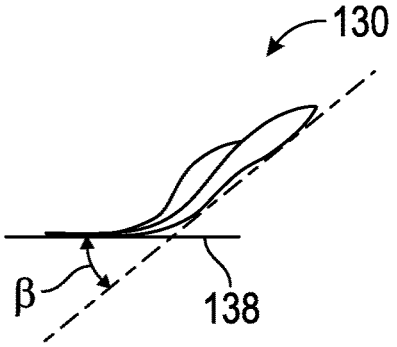
Figure 10D:
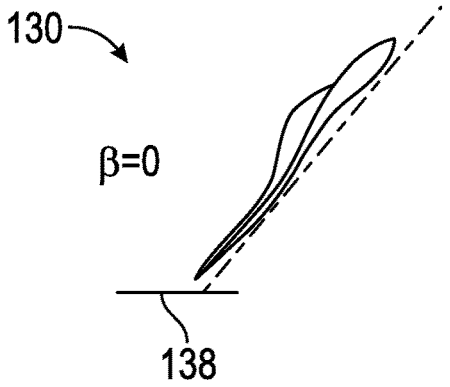
Figure 11A:
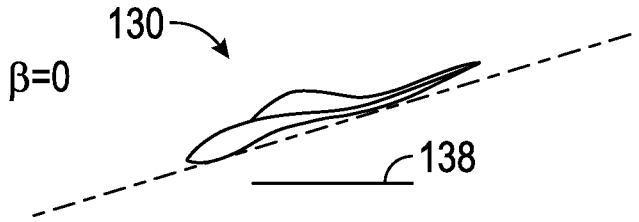
FIG. 11-A to FIG. 11-D are views of a left orthotic/propulsion plate during the different phases of a step or stride.
Figure 11B:
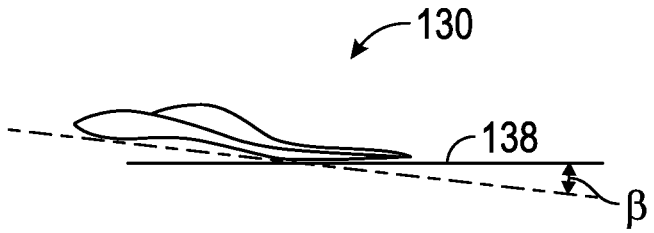
Figure 11C:
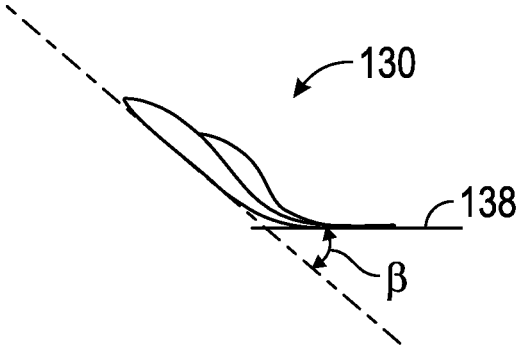
Figure 11D:
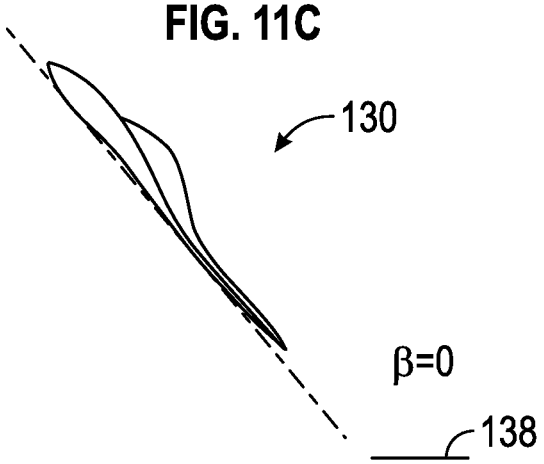

FIG. 9 is a side view of the orthotic/propulsion plate 130 from FIG. 8. The thickness of the material that makes up the orthotic/propulsion plate 130 may vary. For instance, for a female small sized orthotic/propulsion plate, the thickness may be about 1 mm at the toe 142, about 1.25 mm at the sulcus 146, and about 1.5 mm at the ball 150 to the heel 154. The small sized female orthotic/propulsion plate may correspond to ladies' shoe sizes 5-6. For a female medium sized orthotic/propulsion plate, the thickness may be about 1.25 mm at the toe 142, about 1.5 mm at the sulcus 146, and about 1.75 mm at the ball 150 to the heel 154. The medium sized female orthotic/propulsion plate may correspond to ladies' shoe sizes 7-8. For a female large sized orthotic/propulsion plate, the thickness may be about 1.5 mm at the toe 142, about 1.75 mm at the sulcus 146, and about 2 mm at the ball 150 to the heel 154. The large sized female orthotic/propulsion plate may correspond to ladies' shoe sizes 9-10. For a female extra-large sized orthotic/propulsion plate, the thickness may be about 1.75 mm at the toe 142, about 1.75 mm at the sulcus 146, and about 2.25 mm at the ball 150 to the heel 154. The extra-large sized female orthotic/propulsion plate may correspond to ladies' shoe sizes 11-12.

For a male small sized orthotic/propulsion plate, the thickness may be about 1 mm at the toe 142, about 1.25 mm at the sulcus 146, and about 1.5 mm at the ball 150 to the heel 154. The small sized male orthotic/propulsion plate may correspond to men's shoe sizes 6-7. For a male medium sized orthotic/propulsion plate, the thickness may be about 1.25 mm at the toe 142, about 1.5 mm at the sulcus 146, and about 1.75 mm at the ball 150 to the heel 154. The medium sized male orthotic/propulsion plate may correspond to men's shoe sizes 8-9. For a male large sized orthotic/propulsion plate, the thickness may be about 1.5 mm at the toe 142, about 1.75 mm at the sulcus 146, and about 2 mm at the ball 150 to the heel 154. The large sized male orthotic/propulsion plate may correspond to men's shoe sizes 10-11. For a male extra-large sized orthotic/propulsion plate, the thickness may be about 1.75 mm at the toe 142, about 1.75 mm at the sulcus 146, and about 2.25 mm at the ball 150 to the heel 154. The extra-large sized male orthotic/propulsion plate may correspond to men's shoe sizes 12-13. Of course, one of ordinary skill in the art will recognize that smaller and larger thicknesses may be used to depending on the amount of "spring effect" one desires from the orthotic/propulsion plate.

FIGS. 10-A to 10-D show an exemplary orthotic/propulsion plate 130 of a right foot during the different phases of a step or stride. FIG. 10-A shows the orthotic/propulsion plate 130 as the foot is about to strike the ground 138 heel first. At the position shown in FIG. 10-A, the flex angle β is generally 0°, that is the angle made between the toe platform and rest of the orthotic/propulsion plate due to a force applied by a user to the orthotic/propulsion plate, generally during walking, running, and/or jumping. FIG. 10-B shows the orthotic/propulsion plate as the foot begins to leave the ground and a pre-load has already started to occur in the toe platform 114, such that angle β is about 20°. FIG. 10-C shows an even greater pre-load in the toe platform 114, such as there is an angle β of about 45°. FIG. 10-D shows the foot off of the ground 138, and the orthotic/propulsion plate 130 has expended its pre-load by providing thrust or propulsion to the user's foot and/or leg. The angle β is now back to 0°.

FIGS. 11-A to 11-D show orthotic/propulsion plate 130 of a left foot during the different phases of a step or stride. FIG. 11-A shows the orthotic/propulsion plate 130 as the foot is about to strike the ground 138 heel first. At FIG. 11-A, the flex angle β between the toe platform 114 and the rest of the orthotic/propulsion plate 130 is generally 0° (or no angle). FIG. 11-B shows the orthotic/propulsion plate as the foot begins to leave the ground and a pre-load has already started to occur in the toe platform 114, such that β is about 20°. FIG. 11-C shows an even greater pre-load in the toe platform 114, such as there is an angle β of about 45°. FIG. 11-D shows the foot off of the ground 138, and the orthotic/propulsion plate 130 has expended its pre-load by providing thrust or propulsion to the user's foot and/or leg. The angle β is now back to 0°.

In order to form a non-zero angle β, a pre-load force of F is required to create the pre-load (and the flex angle β). The force of course is spread over an area of the orthotic/propulsion plate, and in the table below will be described generally as a pressure (psi). The pressure required to create the flex angle β may range from about 1 psi to about 100 psi. For one embodiment, the pressures P for various flex angles β are shown below:

TABLE

| Flex Angle (β) | Pressure (P) |
|---|---|
| 10° | 6.7 psi |
| 20° | 9.4 psi |
| 30° | 12.8 psi |
| 40° | 16.8 psi |
| 50° | 23.8 psi |
| 60° | 28.3 psi |
| 70° | 32.8 psi |
| 80° | 37.2 psi |
| 90° | 39.5 psi |

One of ordinary skill in the art will recognize that the pressure associated with the flex angle β may be changed from the table above depending on the amount of "spring effect" one desires from the orthotic/propulsion plate.

The orthotic/propulsion plate 110, 130 works in that it decreases the rate of dorsiflexion of the toes (loading a spring) and increases the rate of plantarflexion of the toes (releasing the spring) in the 4th phase of gait (e.g., FIGS. 10-D and 11-D). This maximizes the first ray leverage against ground reactive forces, thereby imparting maximum force to improve propulsion linearly (forward) and vertically (up) and laterally (side to side).

Figure 12:
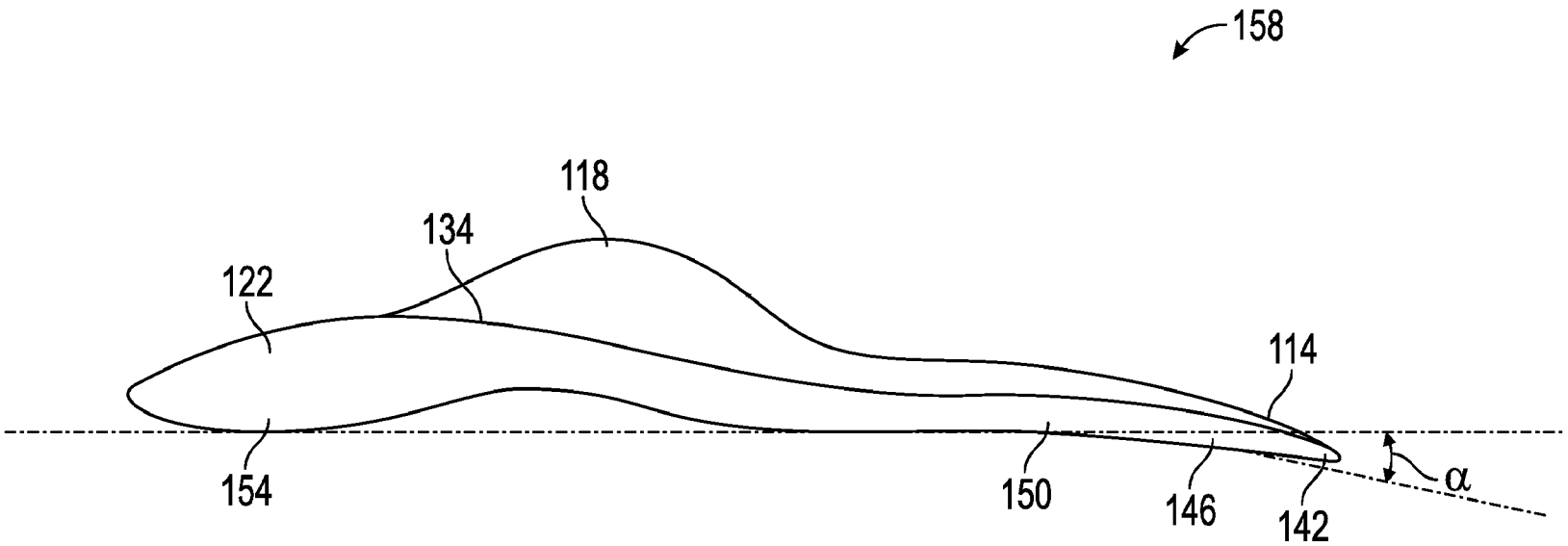
FIG. 12 is a side view of another embodiment of a right orthotic/propulsion plate according to the present disclosure.

FIG. 12 shows another embodiment of an orthotic/propulsion plate 158. In this embodiment, there is an additional preload in the orthotic/propulsion plate 158. That is, there is a dip in the toe 142 with respect to the toe platform 114, such that the toe 142 makes an angle α with the toe platform. The dip in the big toe area gives the orthotic/propulsion plate a little more spring. The normal human gait starts at heel strike which is at the back/outside portion of the heel. As gait progresses, the foot rolls through the arch area and the center of gait starts to move medially and, finally, the last thing that leaves the ground is the big toe. Therefore, if the big toe is the last thing that leaves the ground, then the big toe area of the orthotic/propulsion plate must be the last thing that leaves the ground. To accomplish this, the big toe area of the orthotic/propulsion plate may dip and provide the last thing on the ground with more spring. Having an angle α gives the orthotic 58 an increased spring loading rate. The angle α may range from about 1° to about 25°, and is preferably about 15°.

When the orthotic/propulsion plate 158 is placed on a flat surface, the heel and the toe are the only parts that touch the surface. Therefore, when one applies weight to the orthotic/propulsion plate 158, then the entire orthotic/propulsion plate 158 generally flattens, thus preloading the spring effect of the orthotic/propulsion plate 158. This additional preloading may make a big difference. When one flexes his or her foot to walk or run, the spring load is increased, giving the user an extra push.

The disclosed device has many advantages. The shoe with integral orthotic/propulsion plate may be specifically designed for different sports, e.g. a shoe for a basketball player that develops increased vertical propulsion, a shoe for a sprinter with increased linear propulsion, or an orthotic for a tennis player with increased lateral propulsion. The disclosed shoe may provide a more "spring" or "push" to a sprinter that wants quicker, more explosive starts. The shoe may give a marathoner more efficiency and stamina over longer distances. The shoe may assist a basketball player to obtain higher standing jumps. The shoe may replace the insole that comes with off the shelf footwear and give an increase in propulsion no matter what activity an individual participated in. The shoe loads the foot plate while just standing and this spring effect is amplified when the toes are dorsiflexed (turned up). As the foot leaves the ground, preparing for its next heel strike, the shoe unloads into plantar flexion at a rapid rate using ground reactive force to propel the user forward by amplifying push-off.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A shoe with an integral orthotic or propulsion plate, comprising: (a) a shoe comprising an upper and a sole, and (b) an orthotic or propulsion plate positioned between the upper of the shoe and the sole of the shoe and configured to extend from a heel to toes of a wearer; the orthotic or propulsion plate comprising a plurality of pre-impregnated carbon fiber layers; the orthotic or propulsion plate comprising (i) a toe platform region having a ball region and a toe region forward of the ball region, (ii) a longitudinal arch region, and (iii) a heel region, and the orthotic or propulsion plate further defining (i) a top surface, and (ii) a bottom surface in contact with the sole of the shoe; wherein, in absence of an applied force to the top surface of the orthotic or propulsion plate and with the orthotic or propulsion plate resting on a flat surface, the bottom surface of the orthotic or propulsion plate bows upward in the longitudinal arch region relative to the toe platform region and the heel region, and a bottom toe region surface dips at a non-zero angle $\alpha$ from a bottom ball region surface such that only the toe region and heel region contact the horizontal surface in the absence of the applied force; and, wherein the plurality of pre-impregnated carbon fiber layers are positioned such that the orthotic or propulsion plate includes more pre-impregnated carbon fiber layers in the ball region to the heel region as compared to the toe region, thereby imparting greater stiffness in the ball region to the heel region as compared to the toe region.

2. The shoe assembly of claim 1, wherein the non-zero angle $\alpha$ is 1° to about 25°.

3. The shoe assembly of claim 1, wherein the pre-impregnated carbon fiber layers are incorporated into a woven cloth.

4. The shoe assembly of claim 1, wherein the plurality of pre-impregnated carbon fibers are positioned such that the spring plate is 0.5 mm thicker in the heel region as compared to the toe region.

* * * * *